United States Patent [19]

Nakagawa et al.

[11] 4,456,796

[45] Jun. 26, 1984

[54] UNIDIRECTIONAL ELECTRET MICROPHONE

[75] Inventors: Sadayoshi Nakagawa; Mitsuharu Shinohara, both of Fukuoka, Japan

[73] Assignee: Hosiden Electronics Co., Ltd., Osaka, Japan

[21] Appl. No.: 359,555

[22] Filed: Mar. 18, 1982

[30] Foreign Application Priority Data

Mar. 25, 1981 [JP] Japan ..... 56-42922[U]

[51] Int. Cl.[3] ..... H04R 19/01; H04R 19/04

[52] U.S. Cl. ..... 179/111 E; 179/111 R; 179/121 D; 179/179; 307/400

[58] Field of Search ..... 179/111 E, 111 R, 110 A, 179/110 R, 178, 179, 180, 184, 121 R, 121 D; 307/400

[56] References Cited

U.S. PATENT DOCUMENTS

| | | | |
|---|---|---|---|
| 4,117,275 | 9/1978 | Miyanaga | 179/111 E |
| 4,236,051 | 11/1980 | Nakagawa et al. | 179/111 E |
| 4,281,222 | 7/1981 | Nakagawa et al. | 179/111 E |

*Primary Examiner*—Harold I. Pitts
*Assistant Examiner*—Danita R. Byrd
*Attorney, Agent, or Firm*—Pollock, Vande Sande & Priddy

[57] ABSTRACT

A partition wall is held in contact with a back electrode on the opposite side from a diaphragm, and a fine acoustic path is formed in at least one of the contact surfaces of the partition wall and the back electrode. The acoustic path communicates with a sound hole made in the back electrode and a sound hole made in the partition wall. The velocity component of sound reaching the back of the diaphragm is controlled by the fine acoustic path.

14 Claims, 10 Drawing Figures

UNIDIRECTIONAL ELECTRET MICROPHONE

BACKGROUND OF THE INVENTION

The present invention relates to a miniaturized electret microphone which employs an electret as a diaphragm or a back electrode and has unidirectional characteristics.

In a unidirectional electret microphone, sound also reaches a diaphragm from behind it and the velocity component of such sound is made to have suitable relationships with respect to the velocity component of sound reaching the front of the diaphragm, thereby obtaining unidirectional characteristics. In the prior art, for instance, as disclosed in FIG. 2 of our U.S. Pat. No. 4,281,222 issued on July 28, 1981, an air-permeable damper cloth is held in contact with a back electrode on the opposite side from the diaphragm so that the sound from behind may reach the back of the diaphragm due to the air permeability of the damper cloth. In order to obtain excellent unidirectional characteristics, the velocity component of the sound from behind has to be of a suitable value suitably controlled by adjusting an acoustic impedance of the damper cloth. In the prior art, the acoustic impedance of the damper cloth is controlled by adjusting the pressure with which the damper cloth is held between the back electrode and another holding member. For instance, the diaphragm, the back electrode, the damper cloth and so forth are disposed one by one in a case and the rear end portion of the case is staked to the back of a rear closing plate member of the case to assemble a microphone. The velocity component of the sound from behind is controlled by adjusting the force of staking the rear end portion of the case. Accordingly, desired characteristics are difficult to obtain with this method and, sometimes, the microphone has to be disassembled for reconstruction. Therefore, the conventional microphone structure is poor in productivity.

Usually, felt, nonwoven fabric, air-permeable foamed resin and so forth have been employed as the damper cloth. In the case of using cloth such as felt or the like, it is frayed into a fringe, making in difficult to uniformly control the velocity component of the sound. The nonwoven fabric is non-uniform in weave, so that it must be used in several layers; this increases the manufacturing costs and offers an obstacle against miniaturization of the microphone.

SUMMARY OF THE INVENTION

It is therefore an object of the present invention to provide an unidirectional electrect microphone which is free from the necessity of adjustment of its directional characteristics, easy to obtain an optimum value of the velocity component of the sound from behind an excellent in productivity and can be microminiaturized at low cost.

According to the present invention, a partition wall is disposed in contact with the back of the back electrode on the opposite side from the diaphragm to acoustically isolate portions defined behind the partition wall and the diaphragm, respectively, and a fine acoustic path is formed in at least one of the contact surfaces of the partition wall and the back electrode. The fine acoustic path communicates with sound holes of the back electrode and the partition wall so that the portions behind the partition wall and the diaphragm are acoustically coupled through the sound holes and the fine acoustic path only. The fine acoustic path is formed by a minute groove or irregularities, that is, a rough surface, and it can be easily formed in a predetermined shape in one or both of the contact surfaces of the partition wall and the back electrode. Accordingly, by designing the fine acoustic path in such a manner that the velocity component of the sound from behind may be controlled by the acoustic path to take a predetermined value, it is possible to obtain a microphone of excellent unidirectional characteristics without involving such adjustment as required in the prior art.

DESCRIPTION OF THE PREFERRED EMBODIMENTS

Figure 1:
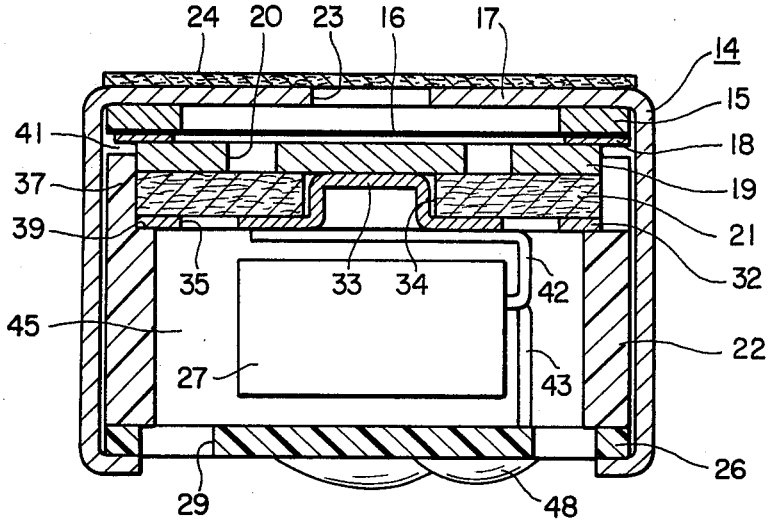
FIG. 1 PRIOR ART
FIG. 1 is a longitudinal sectional view of a prior art unidirectional electret microphone of the type shown in U.S. Pat. No. 4,281,222.

To facilitate a better understanding of the present invention, a description will be given first, with reference to FIG. 1, of the unidirectional electret microphone shown in our prior U.S. Pat. No. 4,281,222. In a cylindrical metal case 14 having its front end almost closed, there is disposed an electret diaphragm 16 in adjacent but spaced relation to a front end plate 17 of the case 14. The electret diaphragm 16 is a film of a synthetic resinous material polarized in the direction of its thickness and has a metal layer deposited on one surface of the film. The electret diaphragm 16 has the metal layer stuck on a metal ring 15, which is, in turn, held in contact with the front end plate 17 of the case 14. A back electrode 19 made of metal is disposed opposite the electret diaphragm 16 with a ringshaped spacer 18 held therebetween, and behind the back electrode 19, a disc-shaped damper cloth 21 is disposed which is made of felt, non-woven fabric, air-permeable porous urethane or like material. The back electrode 19 has bored therethrough a plurality of sound holes 20, and and front end plate 17 has a centrally-disposed front sound hole 23. A dust-proof cloth 24 is stuck on the front end plate 17 to cover the front sound hole 23.

A terminal plate 32, which has a centrally-disposed projection 33, is placed behind the damper cloth 21 in contact therewith, and the projection 33 is snugly fitted in a through hole 34 formed in the damper cloth 21 centrally thereof and is held in contact with the back electrode 19 as by spot welding. The terminal plate 32 has a plurality of holes 35 distributed throughout it. The back electrode 19, the damper cloth 21 and the terminal plate 22 are held together by a back electrode holder 22. The back electrode holder 22 is a cylindrical member made of a synthetic resinous material, and its front end portion is made thin on the inside thereof to have a stepped portion 39, forming a holding portion 37. In the holding portion 37, the terminal plate 32, the damper cloth 21 and the back electrode 19 are sequentially placed one on another while being held on the stepped portion 39. In this case, the front of the back electrode 19 projects out forwardly of the holding portion 37 to define an air gap 41 between the spacer 18 and the front edge of the holding portion 37.

A printed circuit board 26 is disposed in contact with the rear end face of the back electrode holder 22. The rear end portion of the case 14 is bent inwardly to be staked against the back of the printed circuit board 26 so that the parts in the case 14 are fixedly urged against the front end plate 17. In the back electrode holder 22, an impedance converter element 27 is mounted on the printed circuit board 26, and an input terminal 42 of the impedance converter element 27 is connected with the terminal plate 32. The impedance converter element 27 is used to convert a high-impedance input into a low-impedance output and is usually constituted as a semiconductor integrated circuit in which a field effect transistor and resistance element are interconnected in the source follower manner. A terminal lead-out portion of the impedance converter element 27 faces towards the inner surface of the back electrode holder 22 and an input terminal 42, an output terminal 43 and a ground terminal 44 (not shown) are bent forwardly and backwardly of the impedance converter element 27, respectively, and the terminals 43 and 44 are soldered to individual leads of the printed circuit board 26, as indicated by 48.

Inside the back electrode holder 22 is defined a rear compartment 45, which is designed to communicate with the outside. That is, the printed circuit board 26 has formed therein a plurality of sound holes 29. Accordingly, sounds entering into the rear compartment 45 from the outside through the sound holes 29 reach the back of the electret diaphragm 16 after passing through the holes 35, the damper cloth 21 and the sound holes 20, and the sounds reaching the electret diaphragm 16 both from behind and from in front are made to bear a suitable relationship to each other in terms of magnitude to achieve the desired unidirectional characteristics.

In the prior art microphone described above, the velocity component of the sound reaching the diaphragm 16 from behind is controlled by the damper cloth 21. This control is adjusted by adjusting the force that compresses the damper cloth 21, for instance by adjusting the force that presses the rear end portion of the case 14 against the printed circuit board 26 for staking. With such adjustment, however, it is very difficult to achieve optimum control of the directivity. When the adjustment is unsatisfactory, the microphone has to be disassembled for reconstruction. Furthermore, in the case of using cloth as the damper cloth 21, it is frayed into a fringe, making it impossible to uniformly control the velocity control of sound. When nonwoven fabric is employed as the damper cloth 21, since it is non-uniform in weave, if several sheets of such nonwoven fabric were put one on another to make the weave uniform, the manufacturing costs would increases. In addition, in order to microminiaturized the microphone, only a few sheets of extremely thin fabric can be used and, consequently, uniform control of the velocity component of sound is difficult.

Figure 2:
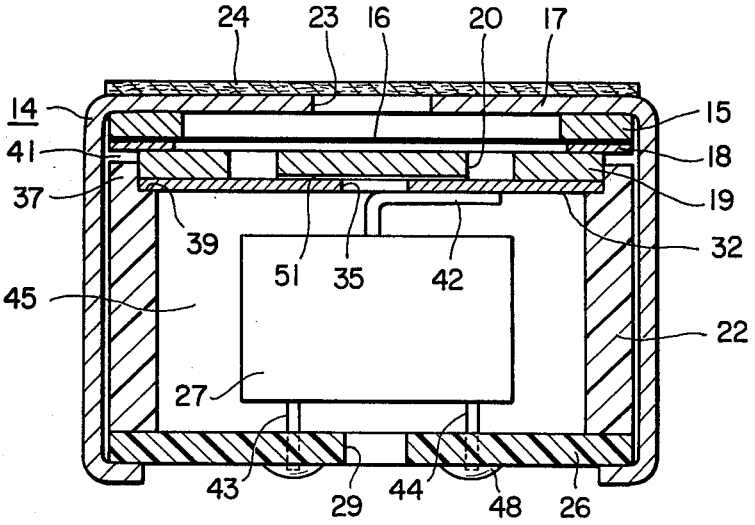
FIG. 2 is a longitudinal sectional view illustrating an embodiment of the unidirectional electret microphone of the present invention.
Figure 3:
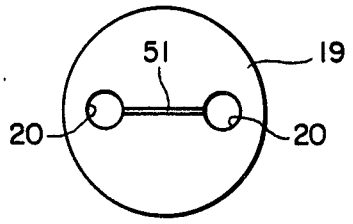
FIG. 3 is a bottom view of a back electrode 19 used in the present invention.

FIG. 2 illustrates an embodiment of the microphone of the present invention. In FIG. 2, the parts corresponding to those in FIG. 1 are identified by the same reference numerals. In this embodiment, the terminal plate 32 serves as a partition wall, too, and it is contacted over almost the entire area of its upper surface with the back electrode 19; consequently, the damper cloth 21 is omitted. A fine groove 51 is cut in the contact surface of the back electrode 19 with the terminal plate 32 so that a pair of sound holes 20 made in the back electrode 19 intercommunicate as shown in FIGS. 2 and 3. The groove 51 extends over a sound hold 35 of the terminal plate 32, and the sound holes 35 and 20 are acoustically coupled with each other through the groove 51. That is to say, the terminal plate 32 functions as a partition wall for acoustically separating the side of the back electrode 19 and the rear compartment 45 from each other. Accordingly, the side of the back electrode 19 and the rear compartment 45 are acoustically coupled only through the groove 51 and the sound hole 35. With such an arrangement, the sound from the rear sound holes 29 reaches the back of the diaphragm 16 through the sound hole 35, the groove 51 and the sound holes 20. By suitable selection of the size and shape of the groove 51, the velocity component of the sound from behind can be controlled to a predetermined value, providing excellent unidirectional characteristics. The groove 51 constitutes a fine acoustic path. For instance, when the grooves 51 was formed to have a V-shaped cross section, about 40$\mu$ deep and about 90° in angle, excellent unidirectional characteristics could be obtained. The groove 51 of predetermined size and shape can easily be obtained. When using the back electrode 19 having the groove 51 of predetermined size and shape and the terminal plate 32 having the sound hole 35 of predetermined size, a microphone of excellent unidirectional characteristics could automatically be obtained without the necessity of adjustment and, in this case, there is no possibility that the microphone will have to be disassembled for reconstruction. Moreover, the structure of the present invention is free from such problems as fray and non-uniform weave experienced in the prior art microphones employing damper cloth, thus permitting easy and inexpensive fabrication of a microminiature microphone.

Figure 4:
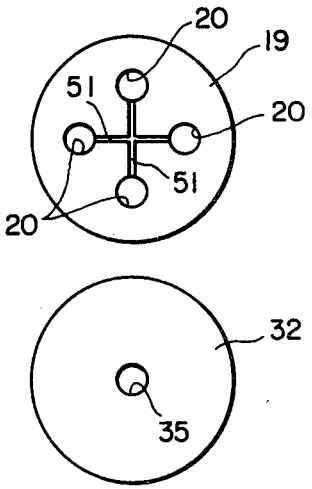
FIG. 4 shows a bottom view of another example of the back electrode 19 and a plan view of a terminal plate 32 for use with the back electrode.
Figure 5:
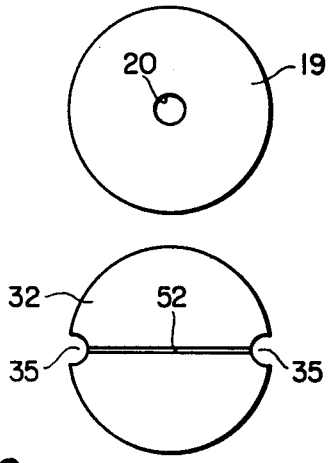
FIG. 5 shows a bottom view of another example of the back electrode 19 and a plan view of the terminal plate 32 for use with the back electrode 19.

FIG. 4 shows a modified form of the groove 51, in which it is formed crosswise in the back electrode 19 and the center of the cross-shaped groove 51 is aligned with the center of the sound groove 35 of the terminal plate 32. It is also possible to cut a groove 52 in the terminal plate 32 as depicted in FIG. 5. In this case, one sound hole 20 is made in the back electrode 19 centrally thereof in opposing relation to the groove 52. In FIG. 5, recesses 35 formed in the terminal plate 32 at both ends of the groove 52 are used to acoustically couple the rear compartment 45 and the groove 52 to one another. Also it is possible to form a cross-shaped groove in the terminal plate 32 in opposing relation to the sound hole 20 of the back electrode 19. Further, instead of forming the grooves 51 and 52, small irregularities on the order of several microns, for instance, may also be formed as minute acoustic paths over the entire area of the surface of one or both of the back electrode 19 and the terminal plate 32. The connection between the back electrode 19 and the terminal plate 32 can be achieved by urging them against each other between the stepped portion 39 and the spacer 18 by staking the rear marginal portion of the case 14 to the printed circuit board 26; however, the back electrode 19 and the terminal plate 32 may also be connected together centrally thereof by meanas of spot welding in the same manner, as described previously in respect of FIG. 1.

Figure 6:
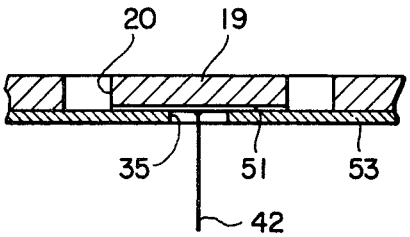
FIG. 6 is a sectional view showing the state in which a partition wall 53 is contacted with the back electrode 19.

A plate of a synthetic resinous material is used as a partition wall 53 in place of the terminal plate 32 as shown in FIG. 6 and the input terminal 42 of the impedance converter element 27 is connected to the back electrode 19 through a sound hole 35 of the partition wall 53. Also in this case, the groove 51 or 52 can be formed in either the back electrode 19 or the partition wall 53 as described above in connnection with FIGS. 2, 3, 4, and 5.

Figure 7:
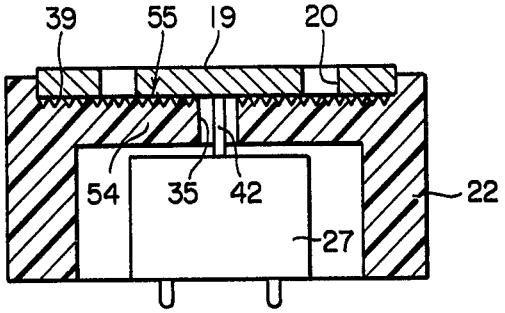
FIG. 7 is a sectional view illustrating another embodiment of the present invention in which a partition wall 54 is formed integrally with a back electrode holder and a fine acoustic path is formed by a rough surface 55.
Figure 8:
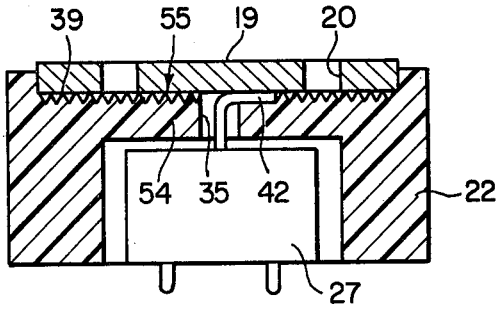
FIG. 8 is a sectional view showing a modified form of the embodiment of FIG. 7.

It is also possible to employ an arrangement of the type shown in FIG. 7 in which a partition wall 54 contiguous to the stepped portion 39 of the back electrode holder 22 amd making contact with the back of the back electrode 19 is formed as a unitary structure with the back electrode holder 22, the sound hole 35 is made in the partition wall 54, and the surface of the partition wall 54 which contacts the back electrode 19 is made rough as indicated by 55 to provide minute acoustic paths for intercommunication between the sound holes 20 and 35. In this case, the back electrode 19 and the input terminal 42 of the impedance converter element 27 may be connected together holding the end portion of the latter between the former and the paritition wall 54 as shown in FIG. 8. In FIGS. 7 and 8, it is also possible to make the surface of the partition wall 54 which contacts the back electrode 19 smooth, to and make the surface of the back electrode 19 which contacts the partition wall 54 rough. The contact surfaces of both the partition wall 54 and the back electrode 19 may also be made rough. Further, it is also possible to cut the groove 51 in one of the back electrode 19 and the partition wall 54 instead of forming the rough surface 55.

Figure 9:
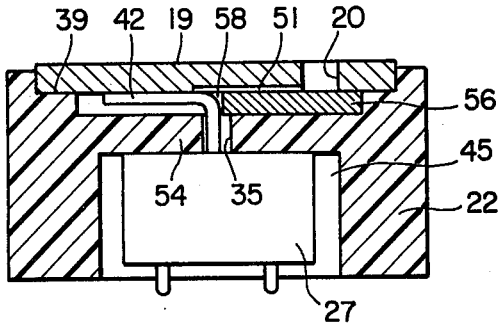
FIG. 9 is a sectional view illustrating another embodiment of the present invention in which an elastic plate 56 is interposed between the partition wall 54 and the back electrode 19.
Figure 10:
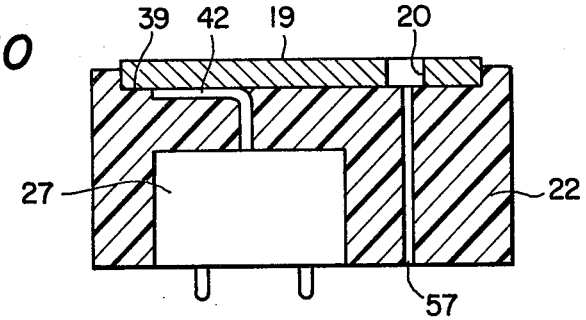
FIG. 10 is a sectional view illustrating another embodiment of the present invention in which the fine acoustic path is formed in the back electrode holder to extend in the direction of its thickness.

In FIG. 9, the back electrode 19 and the partition wall 54 are spaced apart, between which an elastic plate 56 of rubber is buried, permitting acoustic coupling between the rear compartment 45 and the side of the back of the diaphragm 16 through the sound hole 20, the groove 51, a sound hole 58 of the elastic plate 56 and the sound hole 35. In FIG. 10, the impedance converter element 27 is buried in the back electrode holder 22, and an acoustic path 57 leading to the sound hole 20 is formed in the back electrode holder 22 to extend therethrough. In the plane containing the acoustic path 57 the back electrode holder 22 is divided into a holder portion having buried therein the element 27 and an auxiliary portion in such a manner that these divided portions are assembled together to form the acoustic path 57. The acoustic path 57 controls the velocity component of the sound that reaches the back of the diaphragm 16.

While in the foregoing the present invention has been described in connection with the case where the diaphragm 16 is an electret, the invention is also applicable to a microphone in which the back electrode 19 is an electret. In the embodiments described above, it is also possible to employ a covering plate in place of the printed circuit board and directly project out the terminal of the impedance converter element 27 from the covering plate.

It will be apparent that many modifications and variations may be effected without departing from the scope of the novel concepts of this invention.

We claim:

1. A unidirectional electret microphone comprising:

a tubular case having at one end thereof a front end plate formed integrally therewith, said front end plate having a front sound hole therein;

a diaphragm disposed in the case in parallel relation to said front end plate;

a back electrode disposed in the case in parallel relation to said diaphragm, said back electrode having at least one sound hole therein, and one of said back electrode and said diaphragm being formed as an electret;

a partition wall in said case, said partition wall having its front surface in contact with the rear surface of said back electrode, the said partition wall having at least one sound hole therein disposed in opposing relation to said rear surface of said back electrode;

a rear sound hole in the case at the back of the partition wall; and at least one of the surfaces of the back electrode and the partition wall which contact one another being formed to define at least one air path of small predetermined dimensions, said air path being positioned in said surface to acoustically couple the sound hole of said back electrode and the sound hole of said partition wall to one another.

2. A unidirectional electret microphone according to claim 1 wherein said partition wall is a terminal plate which is electrically connected with said back electrode; and an impedance converter element disposed in said case, said impedance converter having an input terminal connected to said terminal plate.

3. A unidirectional electret microphone according to claim 2 wherein a tubular electrode holder is disposed in the case at the back of the diaphragm; the terminal plate and the back electrode being disposed one on the other with their marginal portions supported on a stepped portion formed in the inner peripheral surface of the electrode holder at the front end thereof; and the impedance converter element being disposed in a rear compartment defined inside the electrode holder.

4. A unidirectional electret microphone according to claim 3 wherein a covering plate forming the back of the case is mounted on the back of the electrode holder; the rear end portion of the case being staked to the back of the covering plate to press the diaphragm, the back electrode, the terminal plate and the electrode holder towards the front end plate, mechanically fixing them in the case; and the rear sound hole being made in the covering plate.

5. A unidirectional electret microphone according to claim 4 wherein the covering plate is a printed circuit board; a terminal of the impedance converter element being connected to the printed circuit board.

6. A unidirectional electret microphone according to claim 1 wherein the partition wall is fabricated of an insulating material.

7. A unidirectional electret microphone according to claim 6 wherein an impedance converter element is disposed in the case; an input terminal of the impedance converter element being connected to the back electrode through said sound hole in the partition plate.

8. A unidirectional electret microphone according to claim 1 wherein a tubular electrode holder is disposed in the case at the back of the diaphragm; said partition wall being formed as a unitary structure in the front end portion of the electrode holder at substantially right angles to the axis thereof; and the back electrode being held by the electrode holder in contact with the front of the partition wall.

9. A unidirectional electret microphone according to claim 8 wherein the space defined by the electrode holder inside thereof at the back of the partition wall forms a rear compartment for receiving an impedance converter element, an input terminal of the impedance converter element being connected to the back electrode through said sound hole in the partition wall.

10. A unidirectional electret microphone according to any one of claims 1 to 9 wherein said air path comprises a plurality of fine paths formed by irregularities of one of the surfaces of the back electrode and the partition wall which contact one another.

11. A unidirectional electret microphone according to one of claims 1 to 9, wherein one of the back electrode and the partition wall has two sound holes therein, said air path being a straight groove extending between said two sound holes and communicating said two holes with each other, the intermediate portion of said groove being opposite the sound hole made in the other one of the back electrode and the partition wall.

12. A unidirectional electret microphone according to one of claims 1 to 9, wherein said air path comprises a cross-shaped groove, one of the back electrode and the partition wall having four sound holes therein at the four respective ends of said cross-shaped groove, the intersection of the cross-shaped groove being positioned opposite the sound hole made in the other one of the back electrote and the partition wall.

13. A unidirectional electret microphone comprising:

a tubular case having at one end a front end plate formed integrally therewith, said front end plate having a front sound hole therein;

a diaphragm disposed in said case adjacent to said front end plate in parallel relation thereto;

a back electrode disposed in said case in parallel relation to said diaphragm, said back electrode having at least one sound hole therein;

one of said back electrode and said diaphragm being formed as an electret;

an elastic plate disposed in contact with a rear surface of said back electrode, said elastic plate having a through hole therein opposing the rear surface of said back electrode;

a partition wall disposed in contact with said elastic plate so as to sandwich said elastic plate between said partition wall and said back electrode, said partition wall having a sound hole therein in communication with said through hole of said elastic plate;

at least one groove in the rear surface of said back electrode defining an air path which acoustically couples the sound hole of said back electrode to the sound hole of said partition wall via the through hole of said elastic plate; and a rear sound hole on said case at the back of said partition wall.

14. A unidirectional electret microphone comprising:

a tubular case having at one end a front end plate formed integrally therewith, said front end plate having a front sound hole therein;

a diaphragm disposed in said case adjacent and parallel to said front end plate;

a back electrode disposed in said case in parallel relation to said diaphragm, said back electrode having a sound hole therein;

one of said back electrode and said diaphragm being formed as an electret;

a cylindrical electrode holder comprising a block of an insulating material in said case, said block being disposed behind the said back electrode in contact therewith for fixedly holding the back electrode;

an impedance converter element disposed in a compartment formed in said electrode holder block at a rear end portion thereof, said impedance converter element having an input terminal which is electrically connected to said back electrode through a hole in said electrode holder block; and a through hole in said electrode holder block which forms an air path through said block that acoustically connects the sound hole of said back electrode to a rear open space of the microphone.

* * * * *